US009545644B2

(12) United States Patent
Ramdhiansing et al.

(10) Patent No.: US 9,545,644 B2
(45) Date of Patent: Jan. 17, 2017

(54) FLUID DISPENSER

(71) Applicant: Rubbermaid Commercial Products, LLC, Winchester, VA (US)

(72) Inventors: Shivan Ramdhiansing, Zoetermeer (NL); Jeroen Govers, The Hague (NL)

(73) Assignee: RUBBERMAID COMMERCIAL PRODUCTS, LLC, Winchester, VA (US)

( * ) Notice: Subject to any disclaimer, the term of this patent is extended or adjusted under 35 U.S.C. 154(b) by 5 days.

(21) Appl. No.: 14/656,766

(22) Filed: Mar. 13, 2015

(65) Prior Publication Data

US 2016/0263604 A1 Sep. 15, 2016

(51) Int. Cl.

| | |
|---|---|
| ***B05B 11/00*** | (2006.01) |
| ***B05B 7/00*** | (2006.01) |
| ***A47K 5/14*** | (2006.01) |
| ***A47K 5/12*** | (2006.01) |

(52) U.S. Cl.

CPC ..... *B05B 11/3087* (2013.01); *A47K 5/1211* (2013.01); *A47K 5/14* (2013.01); *B05B 7/0018* (2013.01); *B05B 11/3025* (2013.01); *B05B 11/3047* (2013.01); *B05B 11/3073* (2013.01); *B05B 7/0037* (2013.01); *B05B 11/0005* (2013.01); *B05B 11/305* (2013.01); *B05B 11/3023* (2013.01)

(58) Field of Classification Search

CPC ..... B05B 11/3073; B05B 11/3047; B05B 11/3025; B05B 11/3087; B05B 11/305; B05B 11/0005;B05B 11/3023; B05B 7/0037; B05B 7/0018; A47K 5/1211; A47K 5/14

See application file for complete search history.

(56) References Cited

U.S. PATENT DOCUMENTS

| | | | | |
|---|---|---|---|---|
| 6,467,651 | B1 * | 10/2002 | Muderlak | A47K 5/1217 222/333 |
| 6,536,629 | B2 | 3/2003 | van der Heijden | |
| 6,929,150 | B2 | 8/2005 | Muderlak et al. | |
| 7,681,765 | B2 | 3/2010 | Muderlak | |
| 8,113,389 | B2 * | 2/2012 | Lewis | A47K 5/1205 222/190 |
| 9,220,377 | B2 * | 12/2015 | Fitzpatrick | A47K 5/16 |
| 2014/0034679 | A1 * | 2/2014 | Fitzpatrick | A47K 5/16 222/190 |

* cited by examiner

*Primary Examiner* — Frederick C Nicolas

(74) *Attorney, Agent, or Firm* — Marshall, Gerstein & Borun LLP

(57) ABSTRACT

A dispensing system includes a pump mechanism that has a liquid chamber, a liquid piston for delivering fluid to a mixing chamber, and a valve component biased to close the outlet from the liquid chamber. The pump mechanism also has an air chamber, and an air piston for delivering air to the mixing chamber. A bore allows passage of a mixture of the air and the liquid from the mixing chamber to a dispensing tube. A pump actuator moves the air piston and the liquid piston to propel a dose of the mixture of the air and the liquid through the bore and into the dispensing tube and to collapse a draw-back chamber. The draw-back chamber expands to draw the mixture of the air and the liquid from the dispensing tube into the draw-back chamber. The valve component is biased to close the first outlet before the draw-back chamber expands.

20 Claims, 18 Drawing Sheets

FLUID DISPENSER

BACKGROUND

Dispensers with draw-back mechanisms are known for dispensing a foamed soap or other material to a user. The draw-back mechanism is used to prevent soap, or other material, from hanging and dripping from the end of the dispensing tube after delivery of the liquid dose. One such dispenser is disclosed in U.S. Pat. No. 7,681,765. Such dispensers may use pumps that dispense foamed liquids. One such pump is disclosed in U.S. Pat. No. 6,536,629.

SUMMARY OF THE INVENTION

In some embodiments a dispensing system comprises a pump mechanism comprising a first inlet for delivering liquid from a container to the pump mechanism. The pump mechanism comprises a liquid chamber receiving liquid from the first inlet, a liquid piston for delivering fluid from the liquid chamber to a mixing chamber through a first outlet, and a valve component biased to close the first outlet. The pump mechanism also comprises a second inlet for delivering air to the pump mechanism, an air chamber for receiving air from the second inlet, and an air piston for delivering air from the air chamber to the mixing chamber through a second outlet where a bore is configured to allow passage of a mixture of the air and the liquid from the mixing chamber to a dispensing tube. A draw-back chamber holds a residual mixture of the air and the liquid. A passageway extends between the bore and the drawback chamber. A pump actuator is movable between a first position and a second position to move the air piston and the liquid piston to propel a dose of the mixture of the air and the liquid through the bore and into the dispensing tube and to collapse the draw-back chamber to propel the residual mixture of the air and the liquid through the fluid passageway into the bore. The pump actuator moves to the second position and the draw-back chamber expands to draw the mixture of the air and the liquid from the dispensing tube into the draw-back chamber. The valve component is biased to close the first outlet before the draw-back chamber expands.

The dispensing tube may be located in a spout. The inlet may be connected to a suction tube configured to be disposed in a container of liquid. A bayonette guide may be mounted for movement with the pump actuator and may define the bore extending through the bayonette guide. The drawback chamber may be formed between the pump actuator and the bayonette guide. The draw-back chamber may surround the bore. A pump motor may move the pump actuator to the first position. A spring may bias the pump actuator to the second position. The spring may be compressed when the draw-back chamber collapses. The pump mechanism may include a nozzle insert that receives the mixture of the air and the liquid from the mixing chamber. A spring may bias the valve component to close the first outlet. The pump mechanism may include a nozzle insert that receives the mixture of the air and the liquid from the mixing chamber. The spring may be disposed between the valve component and the nozzle insert. The nozzle insert may be removable from the pump mechanism to allow the spring to be inserted into engagement with the valve component. The spring may be compressed against the nozzle insert. The spring may be compressed when the air piston moves. The spring may comprise an elongated stem that extends from the mixing chamber to the valve component. The stem may be one of a coil, a linear member and a serpentine member. The spring may comprise a head that is disposed between the mixing chamber and the dispensing tube.

In some embodiments, a method of dispensing a liquid air mixture comprises creating a vacuum in a pump mechanism to draw liquid through a first inlet and air from a second inlet; creating a high pressure in the pump mechanism to force liquid through a first outlet and air through a second outlet into a mixing chamber and through a dispensing tube; creating a second vacuum in a draw-back mechanism to draw the mixture of the air and the liquid from the dispensing tube into the draw-back chamber; closing the first outlet before the second vacuum is created.

DETAILED DESCRIPTION

Figure 1:
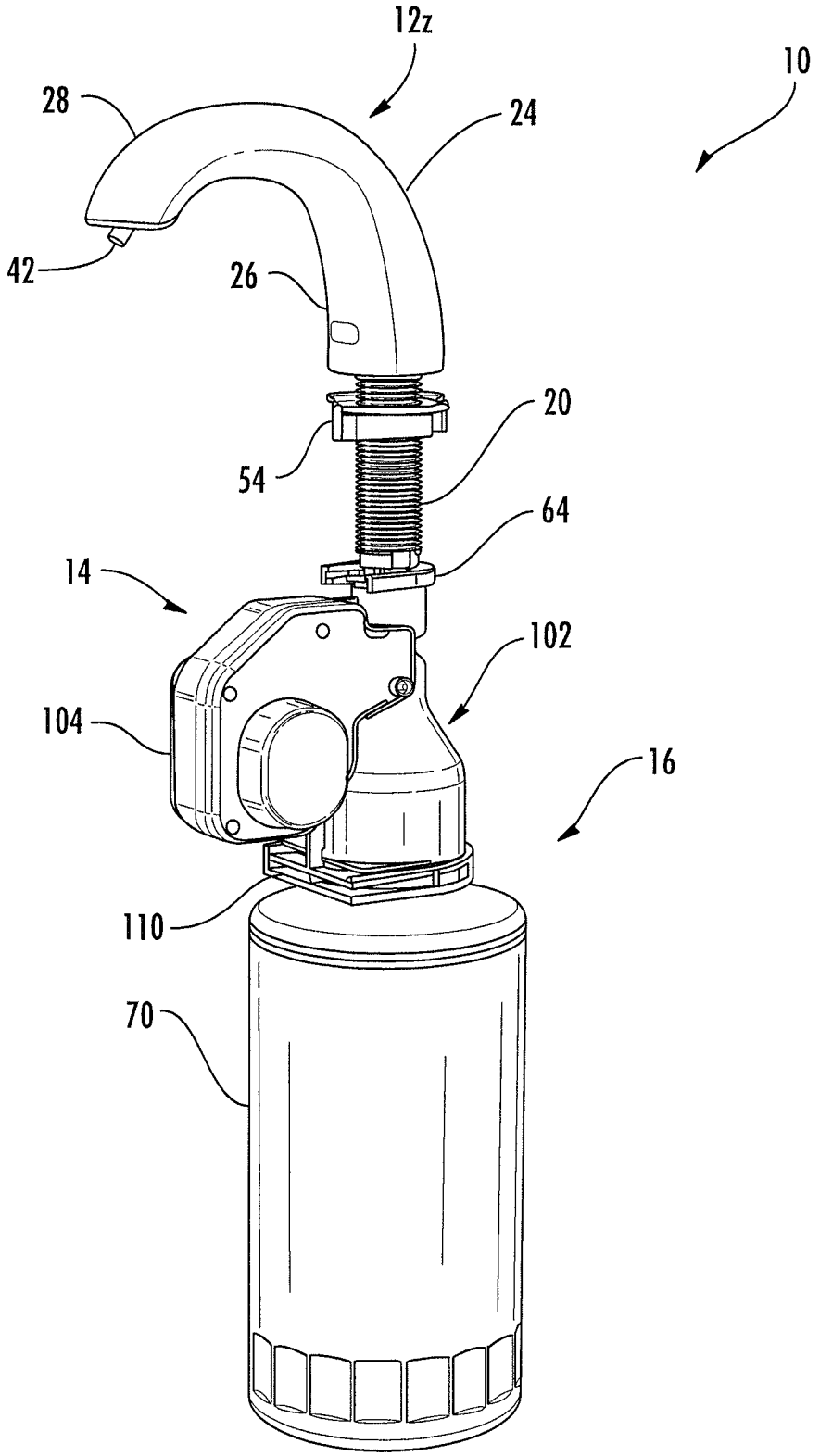
FIG. 1 is a perspective view of an automatic foam soap dispensing system in accordance with an embodiment of the present invention.
Figure 2:
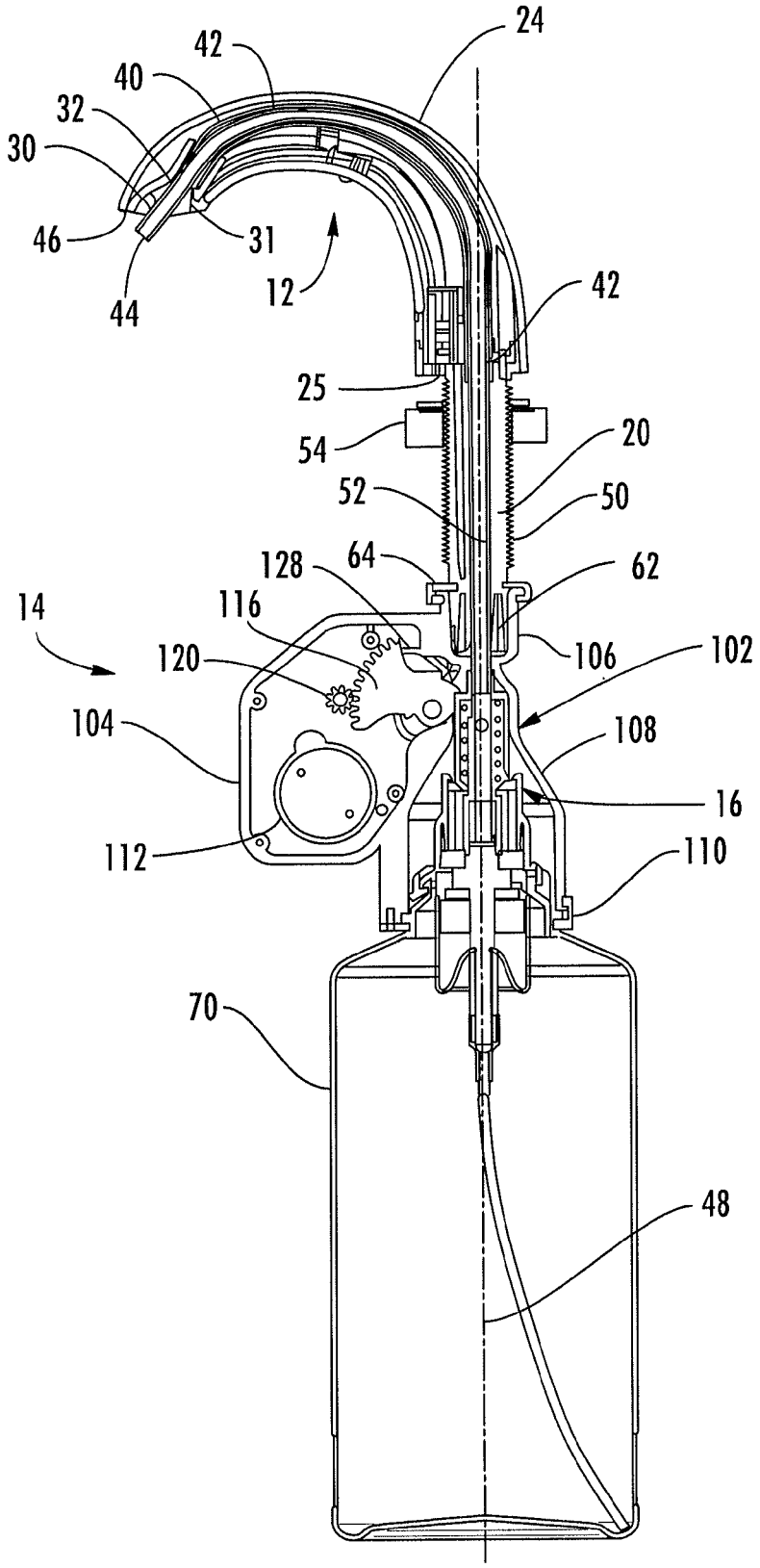
FIG. 2 is a cross-sectional elevation view of the system of FIG. 1.

Referring to FIGS. 1 and 2, an automatic dispensing system 10 is disclosed in accordance with one embodiment of the present invention. The dispensing system may be used in one embodiment to dispense foam soap; however, it will be understood that other fluid products, for example cosmetics products, personal care products, and cleaning products, can also be dispensed using the an automatic foam soap dispensing system 10 without departing from the scope of the invention. Further, it will be understood that the automatic foam soap dispensing system 10 is suited for dispensing other types of non-foaming products, such as sprays or lotions. To simplify explanation of the invention the product dispensed by the dispensing system is described herein as foam soap.

The dispensing system 10 generally includes three major assemblies: a spout assembly 12 to deliver foam soap to a user, a motor housing assembly 14 to actuate and control the operation of the foam soap dispensing system 10, and a pump and draw-back assembly 16 to create foam soap and to prevent soap dripping from the spout assembly 12 between uses. An exemplary dispensing system is found in U.S. Pat. No. 7,681,765 issued Mar. 23, 2010 to Kenneth J. Muderlak, the disclosure of which is incorporated herein by reference in its entirety.

The Spout Assembly

Referring now to the spout assembly 12, an exemplary spout assembly is found in U.S. Pat. No. 6,929,150 issued Aug. 16, 2005 to Kenneth J. Muderlak and Rocky Hsieh, the disclosure of which is incorporated herein by reference in its entirety. In the embodiment of FIGS. 1 and 2, the spout assembly 12 includes a support shaft 20 which may extend through an aperture disposed through a countertop. The support shaft 20 may be hollow and threaded. The support shaft 20 is fixed to, or may form a part of, a rigid spout 24. The rigid spout 24 includes a base 25 abutting the countertop, an upwardly extending indicator housing portion 26, and a curved dispensing portion 28. The outer end of the curved dispensing portion 28 includes an indented outlet 30 having a spout opening 32 therein to aid in dispensing foam soap.

Figure 3:
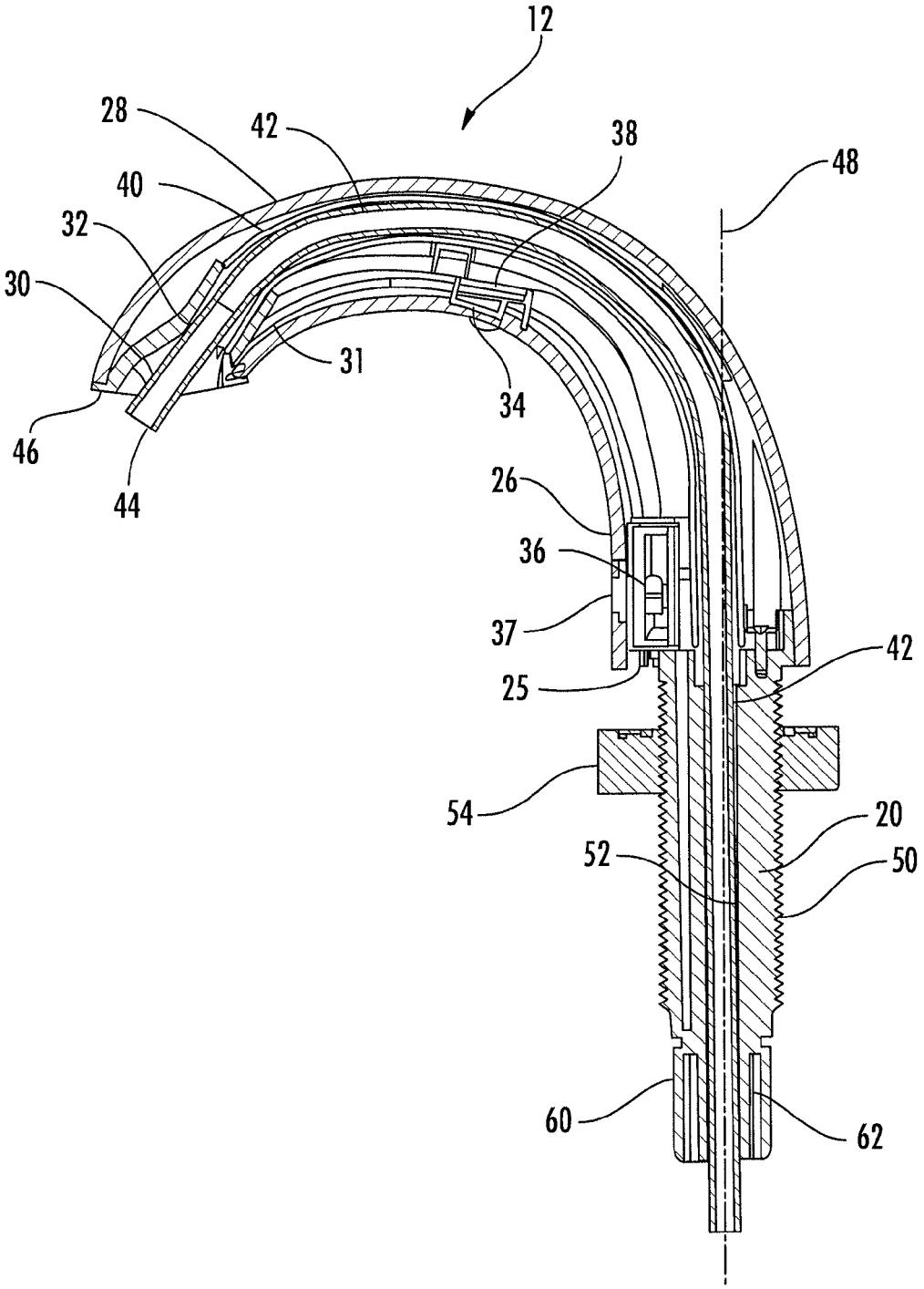
FIG. 3 is a cross-sectional elevation view of the spout assembly of the system of FIG. 1.

As shown in FIG. 3, the spout 24 includes an opening 34 in which an electric eye sensor or assembly 38. Individual sensors, such as infrared (IR) emitter and an IR detector, may be included as part of electric eye assembly 38 to detect the presence of a user's hands beneath the spout opening 32, and, in response, to activate a switch to initiate operation of foam soap dispensing system 10. Indicator lights 36, for example, light emitting diodes (LEDs), may also be disposed behind a transparent lens 37 in the indicator housing portion 26 to signal a "battery low" and/or soap reservoir "empty" condition.

As shown in FIGS. 2 and 3, the rigid spout 24 includes a curved internal passageway 40 that extends from the base 25 through the spout 24 to connect with the spout opening 32. An elongated dispensing tube 42 is disposed in the passageway 40. When the pump and draw-back assembly 16 is attached to the motor housing assembly 14, the tube end 44 of the elongated dispensing tube 42 will move reciprocally in the passageway 40 upon actuation of the pump and draw-back assembly 16, as will be explained. The inner surface of the internal passageway 40 is composed of a smooth material to provide a substantially frictionless or low friction path for movement of the elongated dispensing tube 42 in the passageway 40 during installation and removal of the pump and draw-back assembly 16 and during each actuation of the foam soap dispensing system 10. In addition, the radius of curvature of the internal passageway 40 is configured to allow the elongated dispensing tube 42 to slidably and smoothly move inside the passageway 40. The dispensing tube 42 may be made of LDPE (low density polyethylene), or other suitable material which will not react with the chemicals in the soap, and which provides a smooth outer surface to accommodate almost frictionless movement of the dispensing tube 42 in the passageway 40.

The indented outlet 30 may include an indented portion 31 that is set back from a spout tip 46 of spout 24. The indented portion 31 provides a shield around the tube end 44 of the dispensing tube 42. The indented portion 31 may prevent the tube end 44 from being viewed by a user when the tube end 44 of the dispensing tube 42 extends beyond the spout opening 32.

The passageway 40 is disposed in the spout 24 throughout the length of the passageway 40. As seen in FIG. 2, the lower end of the passageway 40 is disposed along a central or longitudinal axis 48 of a liquid soap container 70. Thus, when the dispensing tube 42 and the container 70 are rotated during installation of a full container 70, the dispensing tube 42 rotates in the passageway 40 about the axis 48 throughout the length of the passageway 40. Since the dispensing tube 42 is centrally located about the axis 48, and is centrally located in the passageway 40, the container 70 is able to be rotated to be properly positioned relative to the motor housing assembly 14 during installation and removal of the container 70.

Referring to FIGS. 2 and 3, the support shaft 20 has external threads 50 and an internal guide passageway 52 centered around the axis 48 through which elongated dispensing tube 42 extends. The guide passageway 52 is configured to allow the dispensing tube 42 to rotate therein during installation and removal of the container 70 and to move reciprocally therein in response to the actuation of the pump and draw-back assembly 16. The external threads 50 are formed in an outer wall of the support shaft 20 substantially along the length thereof. A manually rotatable nut 54 is also provided, including mating internal threads (not shown) which engage the external threads 50 in a known manner, permitting the nut 54 to be rotated and moved upward to engage the underside of a countertop and to secure the support shaft 20 and the spout 24 against movement relative to the countertop.

Extending from the lower portion of the support shaft 20 is a cylindrical attachment shaft 60. The attachment shaft includes a central opening through which the dispensing tube 42 extends along the axis 48. The attachment shaft 60 also includes a plurality of circumferentially disposed splines 62 adapted to mate with a plurality of grooves (not shown) circumferentially disposed in a hollow upper interior portion 106 of the pump housing 102 of the motor housing assembly 14 so as to provide for the attachment of motor housing assembly 14 to the support shaft 20. This arrangement permits the internal guide passageway 52 of the support shaft 20 to align with the upper interior portion 106 of the motor housing assembly 14. In the present embodiment, the splines 62 are disposed at thirty degree intervals.

Upon moving the motor housing assembly 14 into engagement with the attachment shaft 60, the circumferential distance between adjacent splines 62 and grooves disposed in the upper interior portion 106 of the motor housing assembly 14 allows the motor housing assembly 14 to be rotated in thirty degree increments, allowing placement of the motor housing assembly 14 to avoid interfering with the underside of the sink bowl and other plumbing or structural elements located under the countertop. This also allows the motor housing assembly 14 to be positioned for ease of access in case a need to service the foam soap dispensing system 10 arises.

While one embodiment of a spout assembly has been described the pump described herein may be used with other spout assemblies.

The Motor Housing Assembly

As noted above, the motor housing assembly 14 provides the driving force to actuate the pump and draw-back assembly 16 for producing foam soap when it is installed on the support shaft 20. The motor housing assembly 14 may be removably attached to the lower end of support shaft 20 by a shank clip 64, as shown in FIGS. 1 and 2. The shank clip 64 may be generally U-shaped and adapted to engage a circumferentially indented shaft groove 68 formed on the lower portion of the support shaft 20 so as to secure the motor housing assembly 14 to the support shaft 20. The motor housing assembly 14 includes a pump housing 102 and a motor and actuator mechanism housing 104, as shown in FIGS. 1 and 2. The pump housing 102 includes a hollow upper interior portion 106 that receives the attachment shaft 60, as described above. The pump housing 102 also includes a hollow lower interior portion 108 centered along the axis 48 through which foam soap may be conveyed from the pump assembly 16 to the spout 24, as will be explained. A reservoir assembly mounting clip 110 is located at the bottom of pump housing 102 to removably mount the reservoir and pump assembly 16 to the pump housing 102. In particular, the mounting clip 110 is adapted to releasably and securely hold the liquid soap container 70 to the lower end of the pump housing 102. As may be seen in FIGS. 2 and 4, the motor and actuator mechanism housing 104 may include a motor 112, gear reduction train 114 and pump hammer 116. A switch control circuit (not shown) may be electrically connected to the electric eye assembly 38 and the motor 112 to initiate operation of the foam soap dispensing system 10 and control the operation of the motor 112 when the electric eye assembly 38 detects the presence of a user. It will be understood by one of skill in the art that the foam soap dispensing system 10 may also include a battery pack (not shown) for supplying power to the motor 112 and the electronic components of electric eye assembly 38, and that the battery pack may be permanently or removably connected to the motor and actuator mechanism housing 104. A suitable shank clip 64, mounting clip 110 and switch control circuit are described, for example, in U.S. Pat. No. 6,929,150 which is incorporated herein by reference in its entirety.

Figure 5:
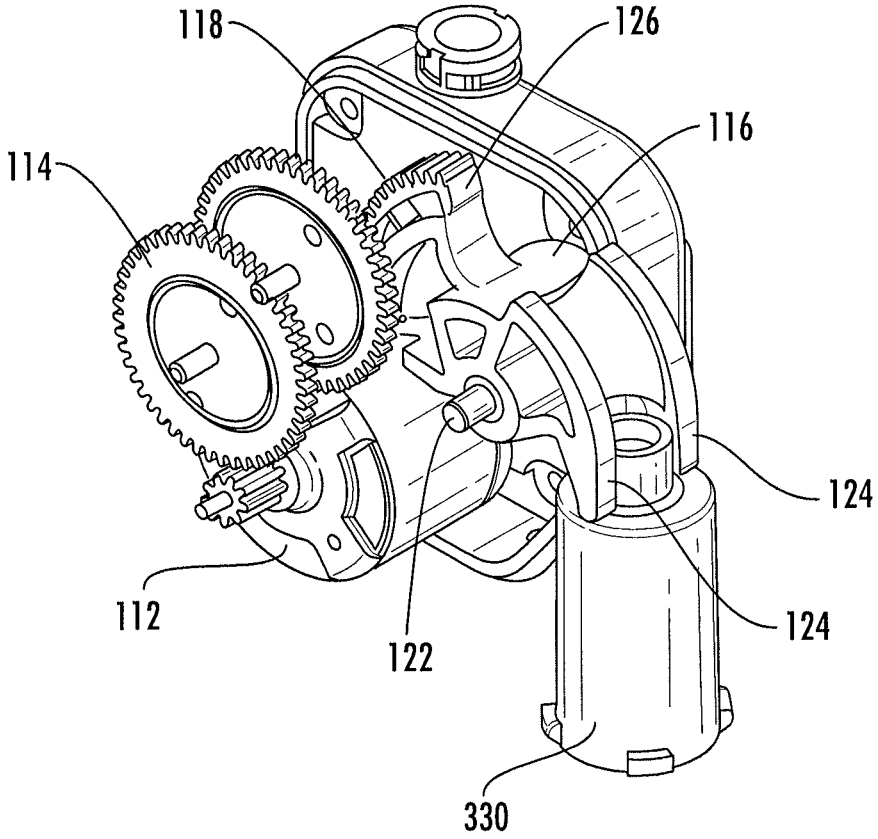
FIG. 5 is a schematic perspective view showing the contact in an actuated position between the pump hammer of the motor housing assembly and the pump actuator of the pump and draw-back assembly of the system of FIG. 1.

The gear reduction train 114 is mounted for rotation in the housing 104 and operatively connects the output of the motor 112 to the pump hammer 116. The pump hammer 116 includes an arcuate gear portion 118 which meshes with a spur gear 120, which in turn is driven by the motor 112 through the gear reduction train 114. The pump hammer 116 is mounted on a pin 122 for rotation through a small arc relative to the housing 104, as shown in FIG. 5. At an end of the pump hammer 116 may be a pair of actuator arms 124 which rotate as pump hammer 116 rotates through a small arc. The pump hammer 116 also includes a flat face 126 adapted to engage a hammer kick back stop 128, which may be rigidly, but adjustably, mounted on the interior of housing 104. Alternatively, the hammer kick back stop 128 may be adjustably mounted on the housing 104. The pump housing 102 is provided with an opening 130 in one sidewall to allow selective contact between pump hammer 116 and a pump actuator 330 of the pump and draw-back assembly 16, as will be explained.

While one embodiment of a motor housing assembly has been described the pump described herein may be used with other spout assemblies.

The Pump and Draw-Back Assembly

Reference now will be made to the pump and draw-back assembly 16, as shown in FIGS. 7-14. The pump and draw-back assembly 16 may include the dispensing tube 42, a pump mechanism 200, and a draw-back mechanism 300 connected between the dispensing tube 42 and the pump mechanism 200 to draw in foam soap from the dispensing tube 42 after a dose of foam soap has been dispensed so as to prevent soap from dripping from the end 44 of the dispensing tube 42 between uses.

Figure 9:
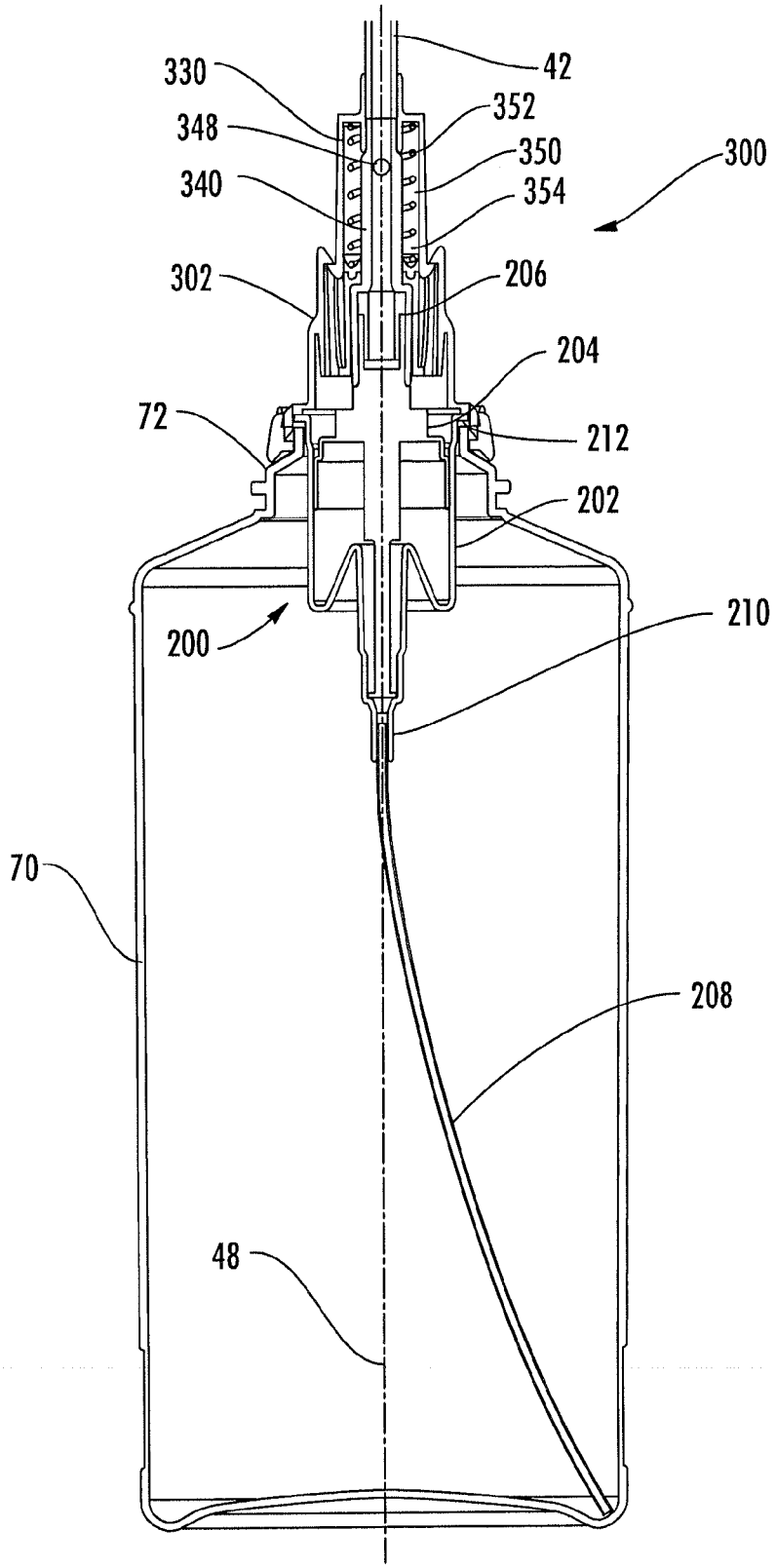
FIG. 9 is a cross-sectional elevation view of the draw-back assembly of the system of FIG. 1 attached to a liquid soap container in a non-actuated position.

The dispensing tube 42, the pump mechanism 200 and the draw-back mechanism 300 may be aligned on a common centerline along the axis 48, as shown in FIG. 9, to provide ease of installation of the pump and draw-back assembly 16. Further, the pump and draw-back assembly 16 may form a unitary assembly that may be discarded when the container 70 has been emptied of liquid soap. Therefore, a replacement pump and draw-back assembly 16 may be furnished with each refill container 70 installed in the dispenser 10.

Figure 7:
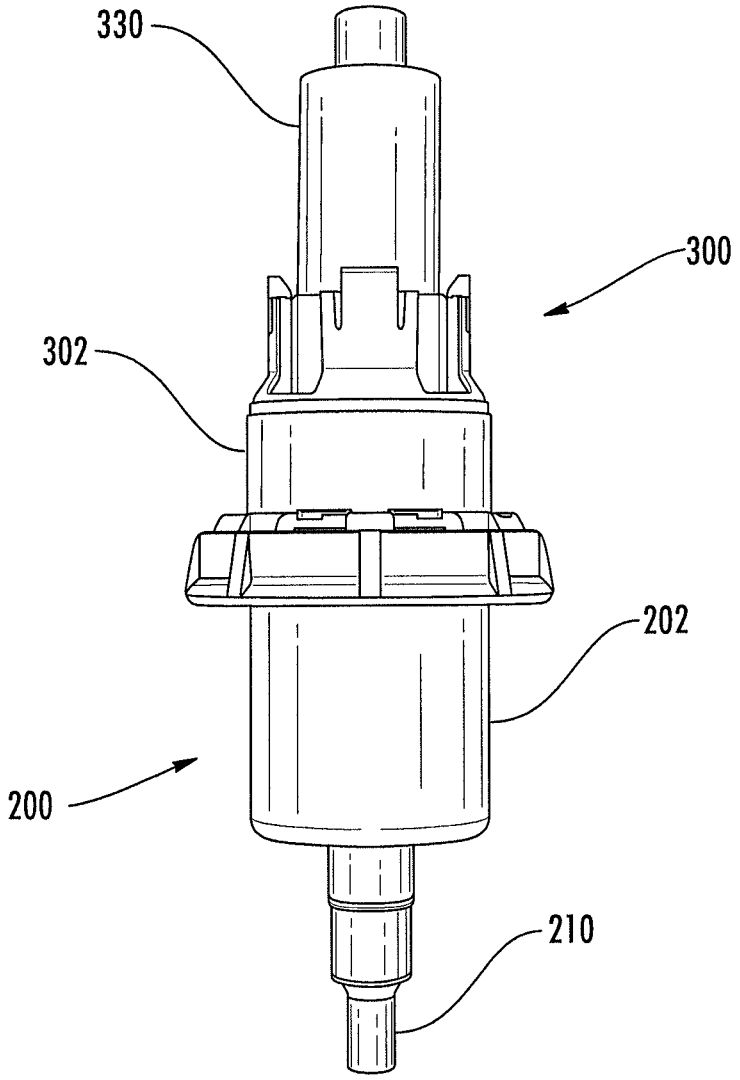
FIG. 7 is a perspective view of the draw-back assembly of the system of FIG. 1.
Figure 8:
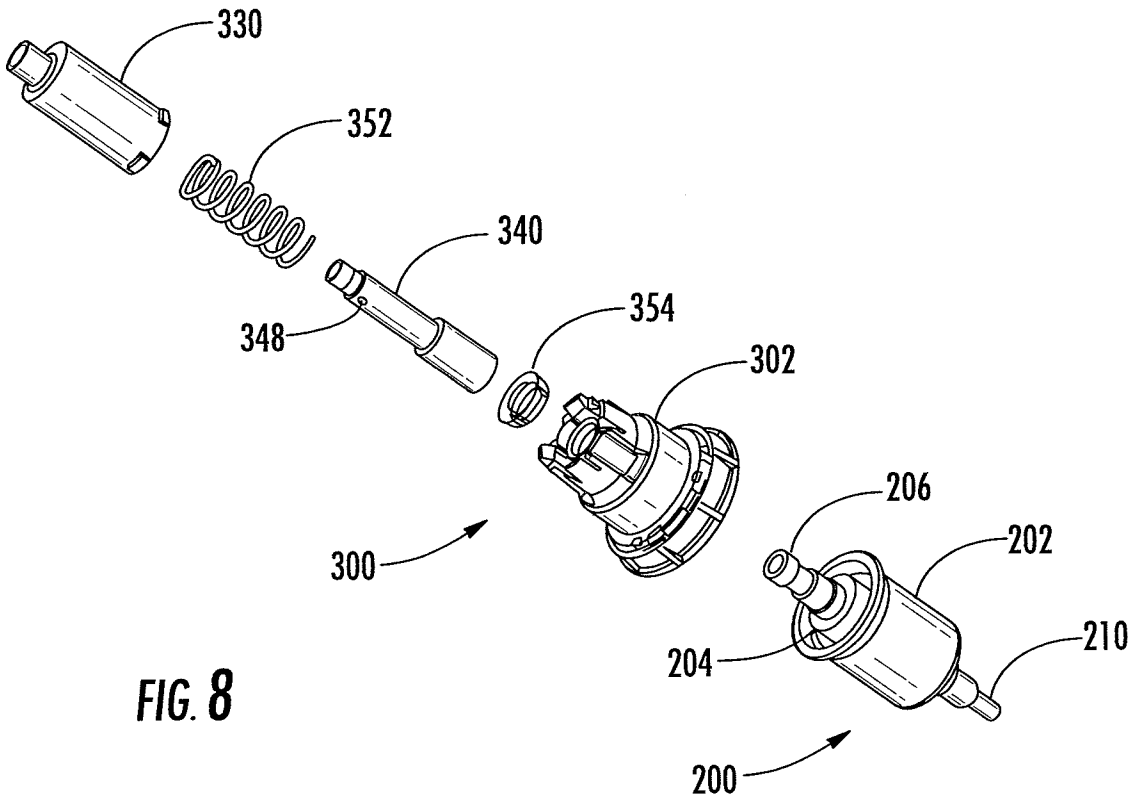
FIG. 8 is an exploded view of the draw-back assembly of the system of FIG. 1.

The draw-back mechanism 300 is disposed in the hollow interior portion 108 of the pump housing 102, as shown in FIG. 2, and is centered around the axis 48. As shown in FIGS. 7-8, the draw-back mechanism 300 includes a cap member 302, a pump actuator 330, bayonette guide 340, a compression spring 352, and a seal 354, which are disposed around the axis 48 concentric with each other.

Figure 10:
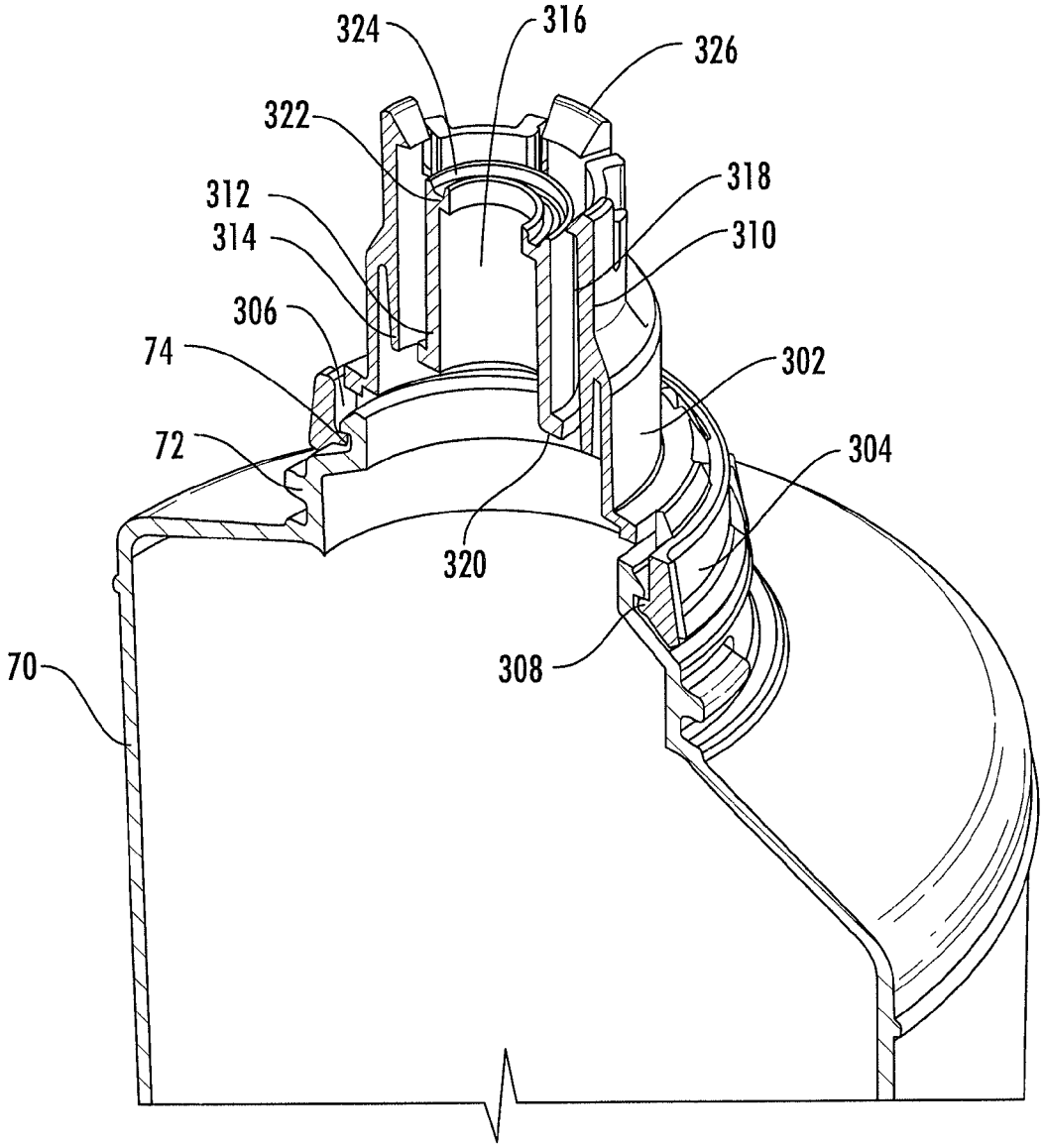
FIG. 10 is a cross-sectional perspective view of the cap member of the draw-back assembly of the system of FIG. 1 attached to a liquid soap container.

Referring to FIGS. 9 and 10, the cap member 302 is secured over the neck 72 of the container 70. The neck 72 of the container 70 is received in a shallow cavity 306 defined by the lower end of the base 304 of the cap member 302. A protruding edge 308 is formed circumferentially around the interior surface of the cavity 306 so as to mate with a neck groove 74 circumscribing the neck 72 of the container 70 for securing the cap member 302 to the container 70.

The body 310 of the cap member 302 has a double wall construction, including a pair of cylindrical inner and outer walls 312, 314 that define a cylindrical central opening 316 and an annular opening 318 concentric with the central opening 316. The inner wall 312 has a circumferential stop lip 320 extending radially outward therefrom at its lower end and an annular seat flange 322 extending radially inward therefrom at its upper end. The annular seat flange 322 defines a seat portion 324. The outer wall 314 is concentric with the inner wall 312 so as to define the annular opening 318 therebetween. The upper end of the outer wall 314 extends out past the upper end of the inner wall 312. A plurality of spaced apart stop members 326 extending radially inward are formed around the perimeter of the upper end of the outer wall 314.

Figure 11:
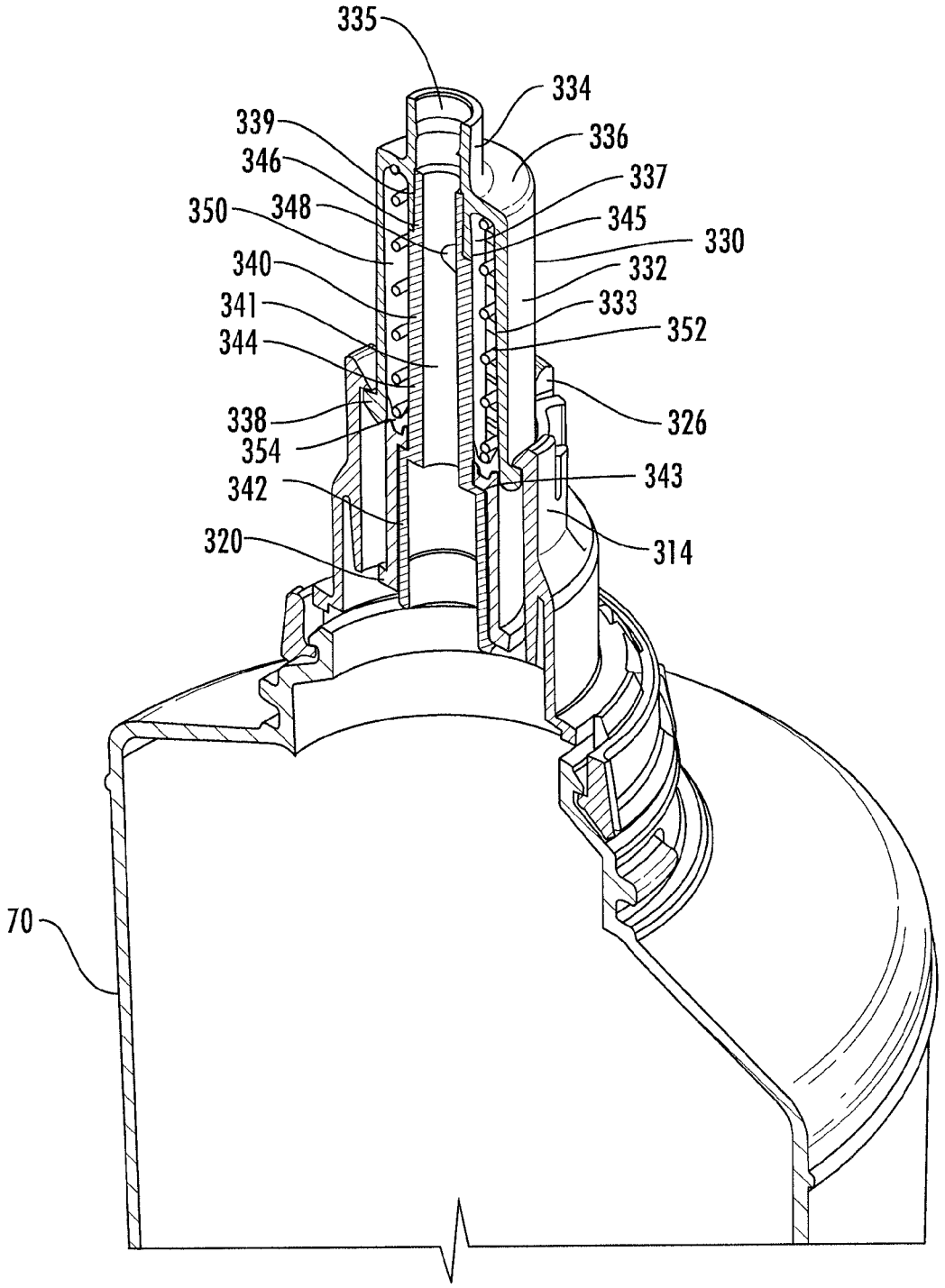
FIG. 11 is a cross-sectional perspective view of the draw-back assembly of the system of FIG. 1 attached to a liquid soap container in a non-actuated position.

Referring to FIGS. 9 and 11, the draw-back assembly also includes a pump actuator 330. The pump actuator 330 has a cylindrical body 332 and a reduced diameter neck portion 334 that is concentric with the cylindrical body 332. The cylindrical body 332 and the reduced diameter neck portion 334 are joined by an annular actuator flange 336 extending radially inward from the cylindrical body 332 at its upper end.

The cylindrical body 332 defines an interior cavity 333. An internal cylindrical projection 337 formed on the annular actuator flange 336 extends axially therefrom into the interior cavity 333 and defines a recess 339 therein. The body 332 is mounted over the cap member 302 concentric with the inner wall 312 of the cap member 302. A guide flange 338 disposed about the lower end of the body of the pump actuator 330 is slidably received within the annular opening 318 of the cap member 302. In this way, the pump actuator 330 is moveably connected to the cap member 302.

The pump actuator 330 moves downward when pump mechanism 200 is actuated, as will be explained. Downward movement of the pump actuator 330 within the annular opening 318 of the cap member 302 is limited by the abutment of the guide flange 338 against the circumferential stop lip 320 of the inner wall 312 of the cap member 302. Upward movement of the pump actuator 330 within the annular opening 318 of the cap member 302 is limited by the abutment of the guide flange 338 against the spaced apart stop members 326 of the outer wall 314 of the cap member 302.

The reduced diameter neck portion 334 defines an axial opening 335 extending therethrough for receiving the elongated dispensing tube 42. Elongated dispensing tube 42 is firmly lodged in cylindrical opening 335 of actuator 330, whereby dispensing tube 42 moves in reciprocal directions within guide passageway 52 along with the movement of actuator 330.

The draw-back mechanism 300 further includes a bayonette guide 340 having a generally cylindrical construction and an axial bore 341 extending therethrough to allow passage of soap from the pump mechanism 200 through the draw-back mechanism 300 and into dispensing tube 42, as will be explained. The bayonette guide 340 includes a cylindrical base portion 342, a cylindrical core portion 344 of reduced diameter joined to the base portion 342 by a first step portion 343, and a cylindrical tip portion 346 of further reduced diameter joined to the core 344 by a second step portion 345.

The tip portion 346 of the bayonette guide 340 is mounted in the recess 339 defined by the cylindrical projection 337 of the pump actuator 330 such that the second step portion 345 abuts the lower end of the cylindrical projection 337 and the core portion 344 is centrally disposed in the interior cavity 333 of the cylindrical body 332 of the pump actuator 330. As a result of this interface between the second step portion 345 and the lower end of the cylindrical projection 337, the pump actuator 330 can drive the bayonette guide 340 downward to actuate the pump mechanism 200, as will be explained.

The core portion 344 of the bayonette guide 340 and the cylindrical body 332 of the pump actuator 330 define a dedicated draw-back chamber 350 therebetween to draw-back foam soap from the dispensing tube 42 after a dose of foam soap has been dispensed, as will be explained. The draw-back chamber 350 is concentric with the axial bore 341 extending through the bayonette guide 340 and is disposed around and in line with the fluid path between the dispensing tube 42 and the pump mechanism 200. The core portion 344 of the bayonette guide 340 has a pair of ports 348 formed opposite each other in a sidewall thereof. The ports 348 form fluid passageways between the axial bore 341 of the bayonette guide 340 and the draw-back chamber 350.

The bayonette guide 340 is further dimensioned such that, when the pump actuator 330 is mounted over the cap member 302 and is fully retracted with the guide flange 338 in abutment against the spaced apart stop members 326, the first step portion 343 abuts the underside of the annular seat flange 322 of the cap member 302 and the base portion 342 is slidably received in the cylindrical central opening 316 of the cap member 302. The base portion 342 of the bayonette guide 340 is connected to the pump mechanism 200 so as actuate the pump mechanism 200, as will be explained.

The draw-back assembly also includes a seal 354 seated in the seat portion 324 defined by the annular seat flange 322 of the cap member 302 and a compression spring 352 mounted over the core and tip portions 344, 346 of the bayonette guide 340. One end of the spring 352 presses against the underside of the actuator flange 336. The other end of the spring 352 presses against the seal 354. In this way, the spring 352 biases the pump actuator 330 away from the cap member 302 and the neck 72 of the container 70. When the spring 352 is unloaded and/or fully extended in its uncompressed state, the pump actuator 330 is in its fully retracted and/or non-actuated position with the guide flange 338 in abutment against the spaced apart stop members 326 (in the position shown in FIG. 11).

Figure 14:
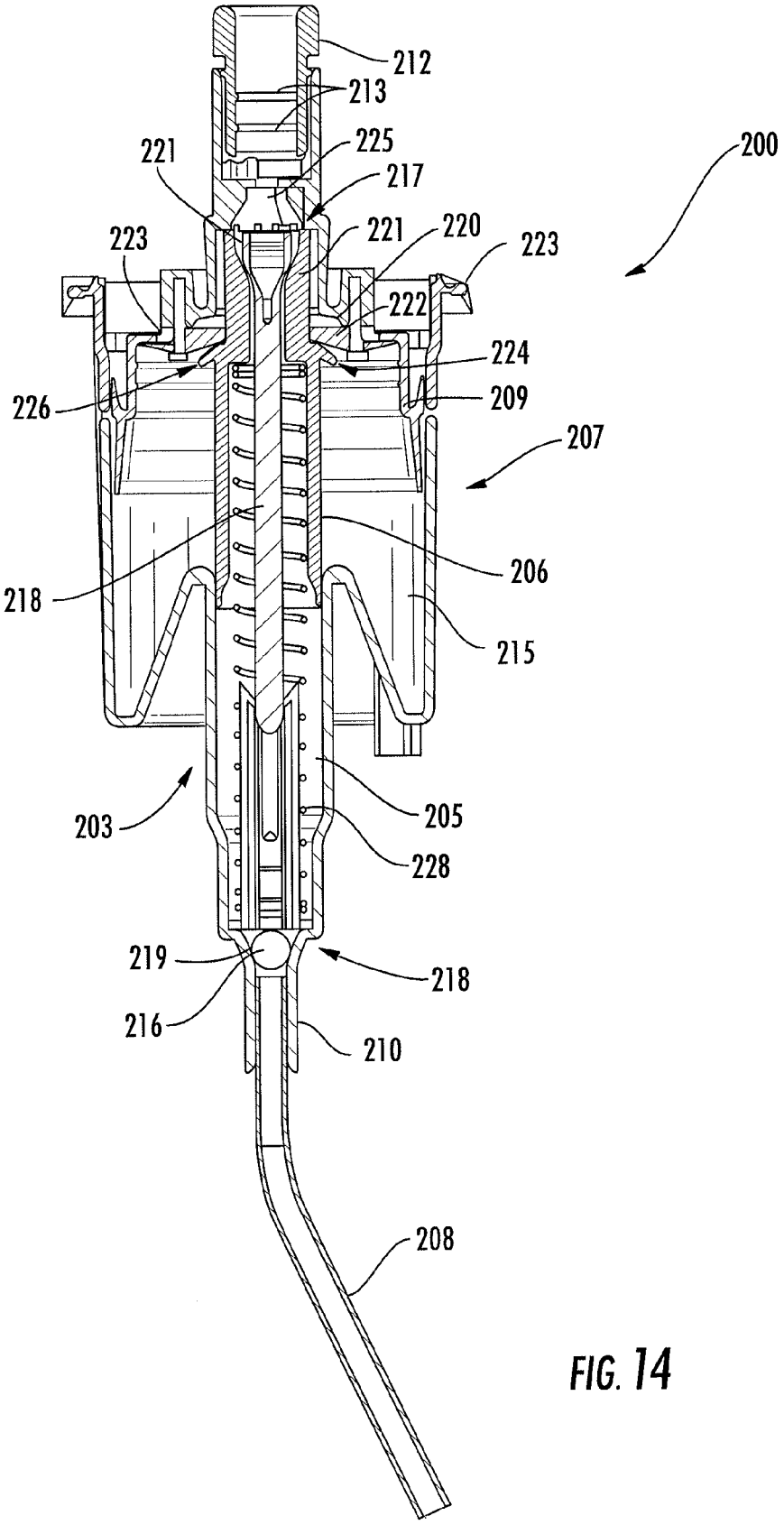
FIG. 14 is a cross-section view of a pump assembly used in the dispenser of FIGS. 1-13 in a non-actuated position.

The pump mechanism 200 is configured to deliver a predetermined dosage of foam soap from tube end 44 of dispensing tube 42 upon each actuation of the motor 112. The pump mechanism 200 may include a standard, self-priming pump as is known in the art for creating foam soap from liquid soap without the use of gas propellants. An embodiment of such a foam pump is shown in FIG. 14 comprising a liquid pump 203 defined by a liquid pump chamber 205 and a liquid pump piston 206 and an air pump 207 comprising an air pump chamber 215 and an air pump piston 209. Both pistons 206 and 209 are operatively coupled to the bayonette guide 340 to deliver a foamed liquid to nozzle insert 212 when the pump actuator 330 is depressed by pump hammer 116. Two small meshes 213 may be located in the nozzle insert 212 in order to facilitate the formation of the foamed liquid.

On end of the suction tube 208 is connected to the pump inlet at a boss 210 and the opposite end of the suction tube 208 extends close to the bottom of the liquid container 70 and serves as an inlet for the pump mechanism 200. A non-return valve 218 is located inlet to the liquid chamber 205 for preventing the flow of liquid into the container 70. The non-return valve 218 may comprise a ball 216 that is engageable with a seat 219 to form a liquid tight seal.

The outlet 217 from the liquid chamber 205 is connected to mixing chamber 225 for delivering liquid from the liquid pump 203 to the mixing chamber 225. The outlet 217 may be selectively closed and opened by a valve comprising a valve seat 221 and a rod-like non-return valve component 218 as shown in greater detail in FIG. 15. The valve component 218 comprises a valve element 221 that is movable into engagement with seat 219 to create a liquid tight seal that closes the outlet 217.

The air pump 207 comprises an inlet 223 and an outlet 224 that are selectively closed and opened by a flexible sealing component 220. The sealing component comprises two annular, resilient sealing lips 226 and 222 which are used to close and open the inlet 223 and the outlet 224 of the pump chamber 207. Inlet 223 may be formed as an aperture in air piston 209 where lip 226 selectively opens and closes the aperture. Outlet 224 may be formed as a space between the liquid piston 206 and the air piston 209 that communicates with mixing chamber 225. The lip 222 selectively opens and closes the space to selectively communicate the air chamber 215 with the mixing chamber 225.

A spring 228 located in the liquid chamber 205 is used to restore the pistons 206 and 209 to the non-actuated position when the pump hammer 116 is deactivated as will be described.

Figure 13:
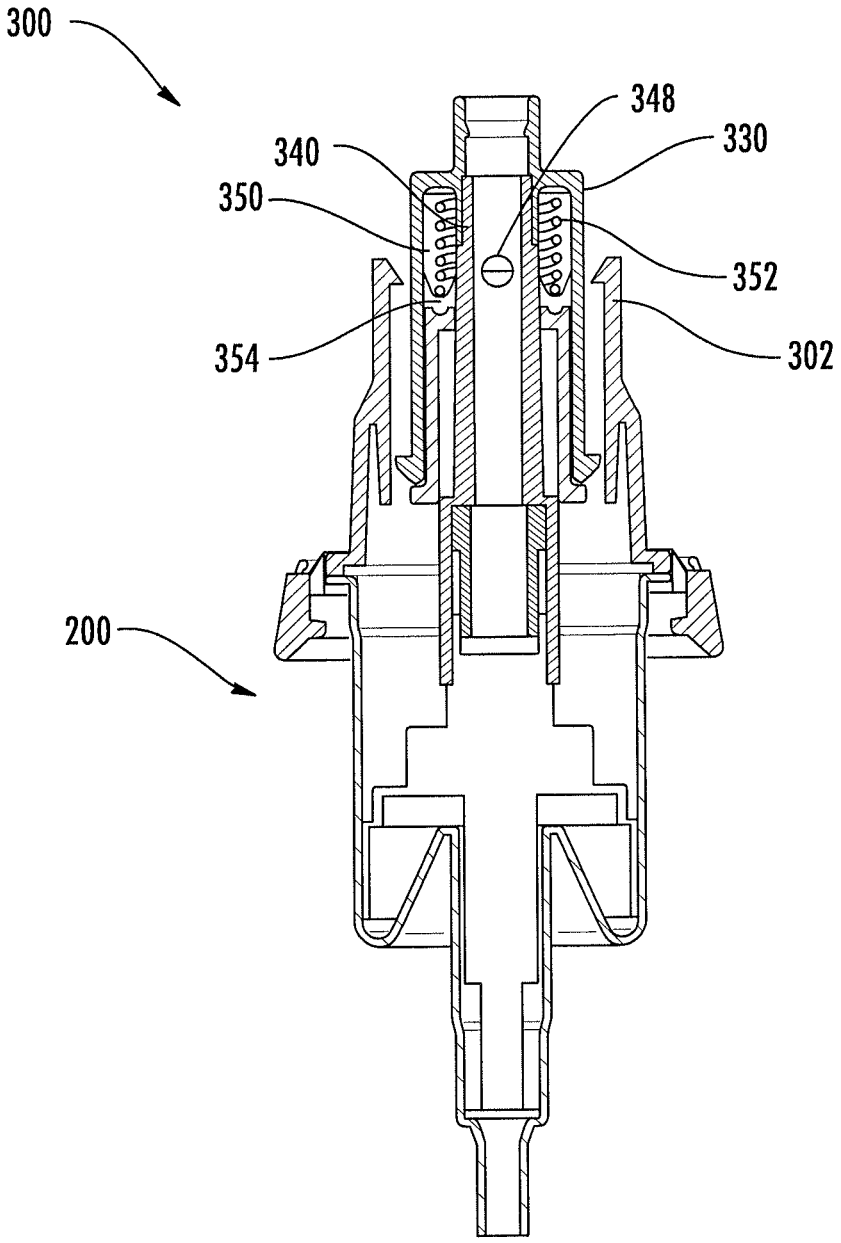
FIG. 13 is a cross-sectional elevation view of the draw-back assembly of the system of FIG. 1 including a schematic view of a pump assembly in an actuated position.
Figure 15:
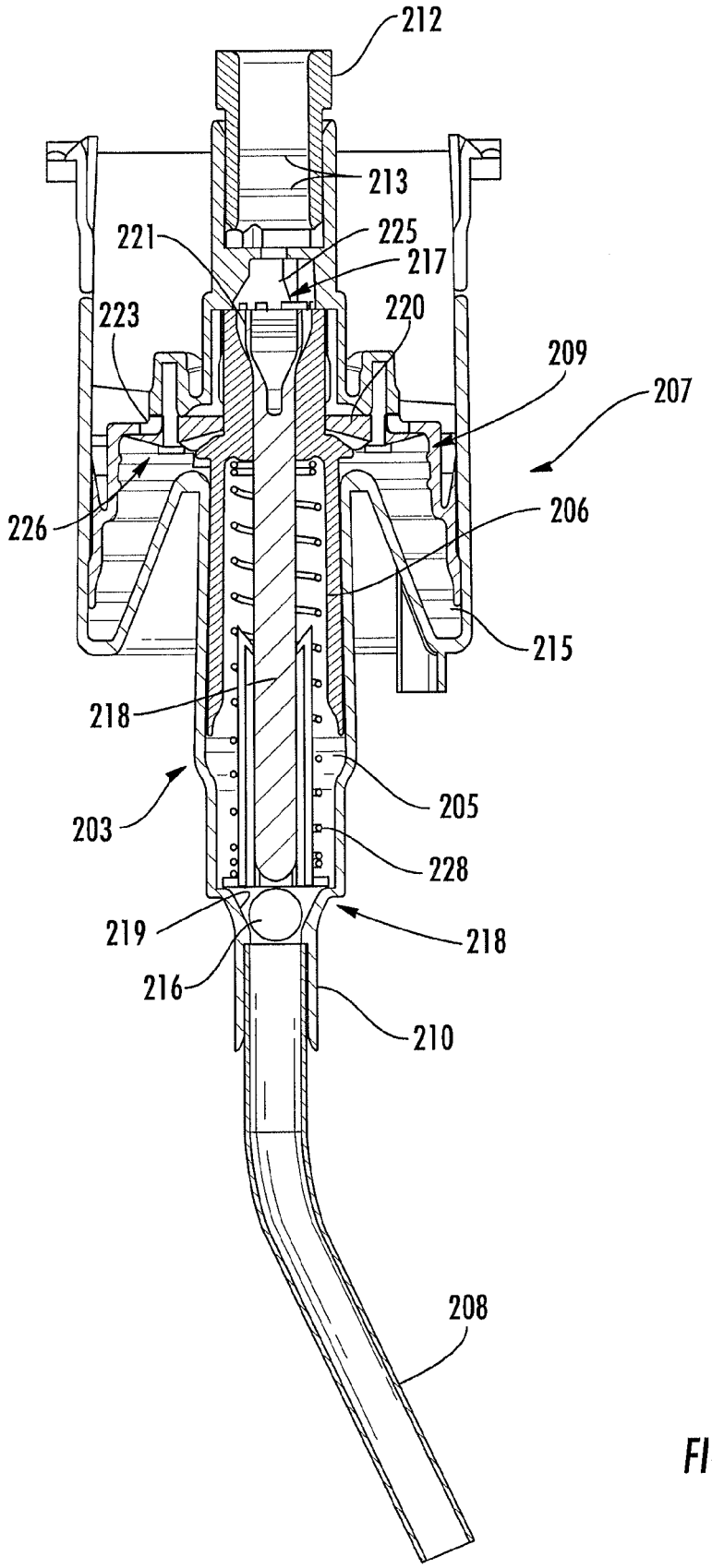
FIG. 15 is a cross-section view of the pump assembly of FIG. 14 in an actuated position.

When the pump is actuated by downward movement of the bayonette guide 340, the pistons 209 and 206 of the air pump 207 and the liquid pump 204, respectively, are moved downwards, with the result that the volumes of the corresponding piston chambers 218 and 205, respectively, are reduced (as shown in FIGS. 13 and 15) and air and liquid are dispensed to mixing chamber 225 via outlets 224 and 217, respectively. As the pistons 209 and 206 are moved downwardly liquid in liquid chamber 205 is forced through the interior passage of the piston 206 where the liquid is delivered to mixing chamber 225 through opening 217. The air in the chamber 215 is forced through opening 224, as valve 222 is forced open, and into mixing chamber 225. The air and liquid are mixed in mixing chamber 225, the mixture is then passed through the two small meshes 213 in the nozzle insert 212, and the mixture is forced through the dispensing tube 32. The pressure in the system forces the foamed soap through tube 32 where it is emitted from opening 44 where it is dispensed to a user in the form of a foam.

After foam has been dispensed, the force on the pistons 209 and 206 is released by the upward movement of bayonette guide 340 and the pistons return to the starting, non-actuated position (FIGS. 12 and 14) by the spring 228. During this return movement, the non-return valve 218 opens and the liquid pump chamber 205 is filled with liquid drawn from the liquid container 70 due to the vacuum created by the expansion of chamber 205. Simultaneously, the air pump chamber 215 fills with air drawn into the chamber 215 through inlet 223 as seal 226 is forced open due to the vacuum created by the expansion of chamber 215. The amount of air and the amount of liquid drawn into chambers 205 and 208 are metered such that when mixed the liquid and air create the desired amount and density of foam delivered to the user.

The container 70 includes neck portion 72 having an opening therein centered around the axis 48 through which the pump mechanism 200 is inserted. In the present embodiment, the upper end of the pump includes a protruding, circular outer edge 223 that rests on the upper end surface of the neck 72 of the container 70. Upon mounting the cap member 302 of the draw-back mechanism 300 over the neck 72 of the container 70, the outer edge 223 of the pump is clamped between the cap member 302 and the neck 72 of the container 70. A seal may be provided between the edge 223 and the neck 72 of container 70 to create an air tight seal therebetween.

When the pump mechanism 200 is mounted to the neck 72 of the container 70 and the draw-back mechanism is mounted on the pump 200, the nozzle insert 212 is received in the axial bore 341 of the base portion 342 of the bayonette guide 340 in abutment against the first step portion 343 joining the base portion 342 and the cylindrical core portion 344. Further, the pump air piston 209 may be secured to the base portion 342 of the bayonette guide 340 in a known manner. For example, the base portion 342 may have a groove circumferentially disposed within the axial bore 341 so as to firmly engage a circumferential thread disposed on the outer surface of the pump air piston 209.

The pump mechanism 200 may be actuated by pushing the nozzle insert 212 inwardly toward the pump chamber 215 by bayonette guide 340. During the compression stroke, the nozzle insert 212 drives the pump air piston 209 into the chamber 215 and the pump liquid piston 206 into chamber 205 so as to create foam soap by mixing liquid soap and air in mixing chamber 225 and to pump the foam soap out through the nozzle insert 212 into tube 32 as previously described. The pump mechanism 200 is spring biased by spring 228 so as to return to its rest state when the downward force on the nozzle insert 212 is released. During the return stroke, the pump mechanism 200 draws in ambient air from the outside via inlet 223 and liquid soap from the container 70 via a suction tube 208. It is contemplated that pump mechanisms may be used in the invention, having structure and operation that may vary from the pump description set forth above.

As noted above, the motor housing assembly 14 provides the driving force for the operation of pump mechanism 200. When the foam soap dispensing system 10 is fully assembled, the motor 112 rotates the actuator arms 124 of the pump hammer 116 to engage the actuator flange 336 of the pump actuator 330 so as to drive down the pump actuator 330. The bayonette guide 340 of the pump actuator 330, in turn, drives down nozzle insert 212 to actuate the pump mechanism 200, as explained above.

When the motor 112 is not energized, the pump hammer 116 is in its full kick back position. The actuator arms 124 of the pump hammer 116 may rest on the upper surface of actuator flange 336, which is in its fully retracted and/or non-actuated position. Alternatively, the actuator arms 124 may be disposed a short distance above the upper surface of actuator flange 336. The actuator arms 124 straddle the reduced diameter neck portion 334 of the pump actuator 330, which extends into the open space 172 of the pump hammer 116.

Figure 6:
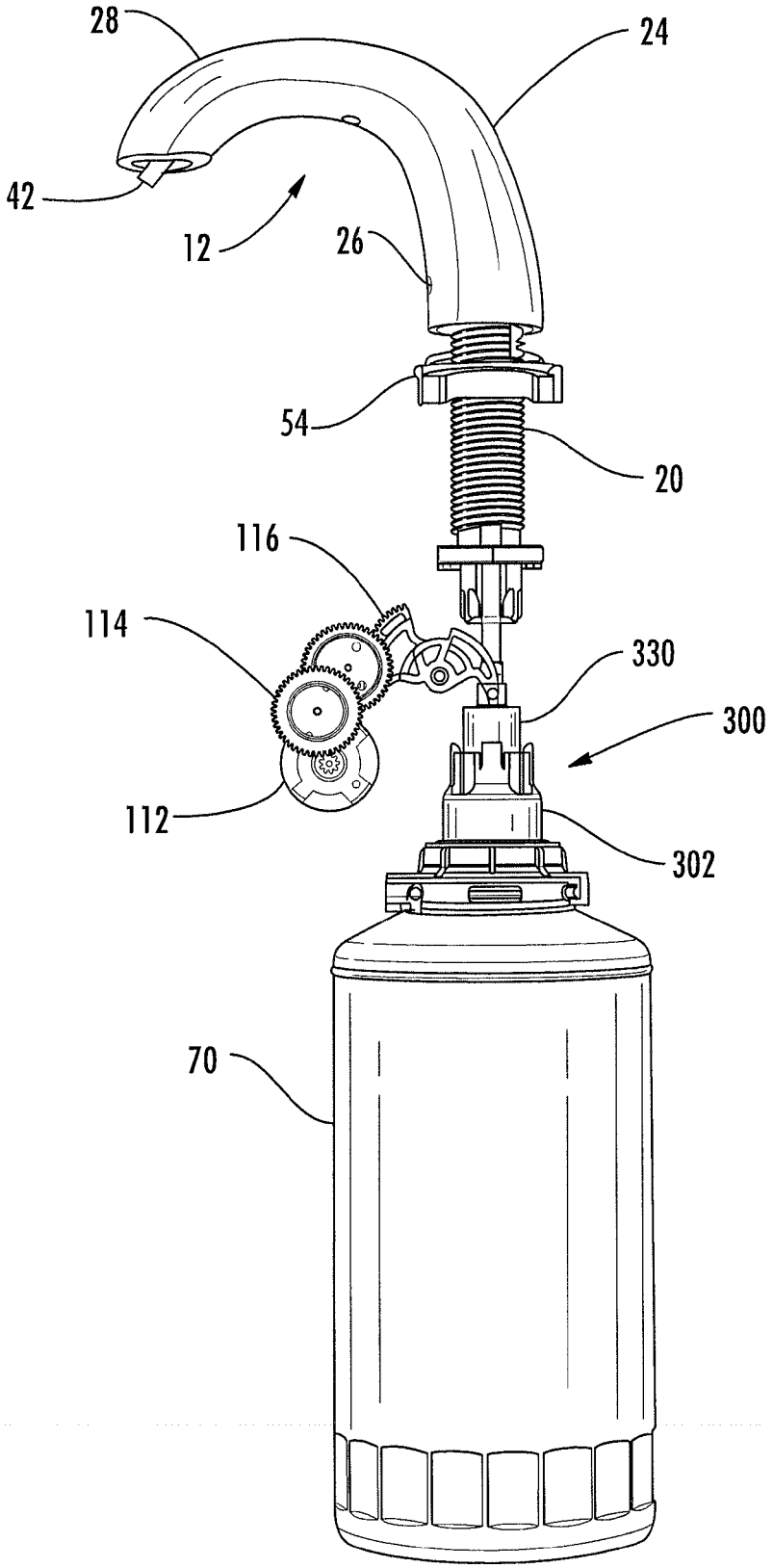
FIG. 6 is another schematic perspective view showing the contact in an actuated position between the pump hammer of the motor housing assembly and the pump actuator of the pump and draw-back assembly of the system of FIG. 1.

Upon actuation of the motor 112, the gear reduction train 114 drives the spur gear 120 which, in turn, rotates the pump hammer 116 clockwise, as shown in FIGS. 5 and 6. As the pump hammer 116 pivots clockwise around pivot pin 122 under the influence of motor 112, the actuator arms 166 engage the actuator flange 336 to drive the pump actuator 330 axially downward into the annular opening 318 of the cap member 302. The pump actuator 330 in turn drives the bayonette guide 340 downward to actuate the pump mechanism 200 by pushing the nozzle insert 212 downwardly.

During the down stroke of the pump actuator 330, the seal 354 seated in the seat portion 324 defined by the annular seat flange 322 of the cap member 302 remains stationary. Therefore, as the pump actuator 330 is driven downward into the annular opening 318 of the cap member 302, the draw-back chamber 350 collapses and the compression spring 352 mounted over the bayonette guide 340 is compressed. In this way, residual soap material present in the draw-back chamber 350 may be forced out of the chamber 350 and into the fluid path through the ports 348 between the axial bore 341 of the bayonette guide 340 and the draw-back chamber 350 to be dispensed with the main dose of foam soap being dispensed by the pump mechanism 200 down the dispensing tube 42.

The amount of downward movement of pump actuator 330 generally determines the amount of foam soap that is dispensed from dispensing tube 42 at tube end 44 upon each actuation of the automatic soap dispenser 10. The distance of the downward movement of the pump actuator 330 is controlled by the position of hammer kick back stop 128. To dispense a desired dosage of the foam soap, flat face 126 of pump hammer 116 abuts kick back stop 128, thus halting further clockwise rotation of pump hammer 116.

Figure 4:
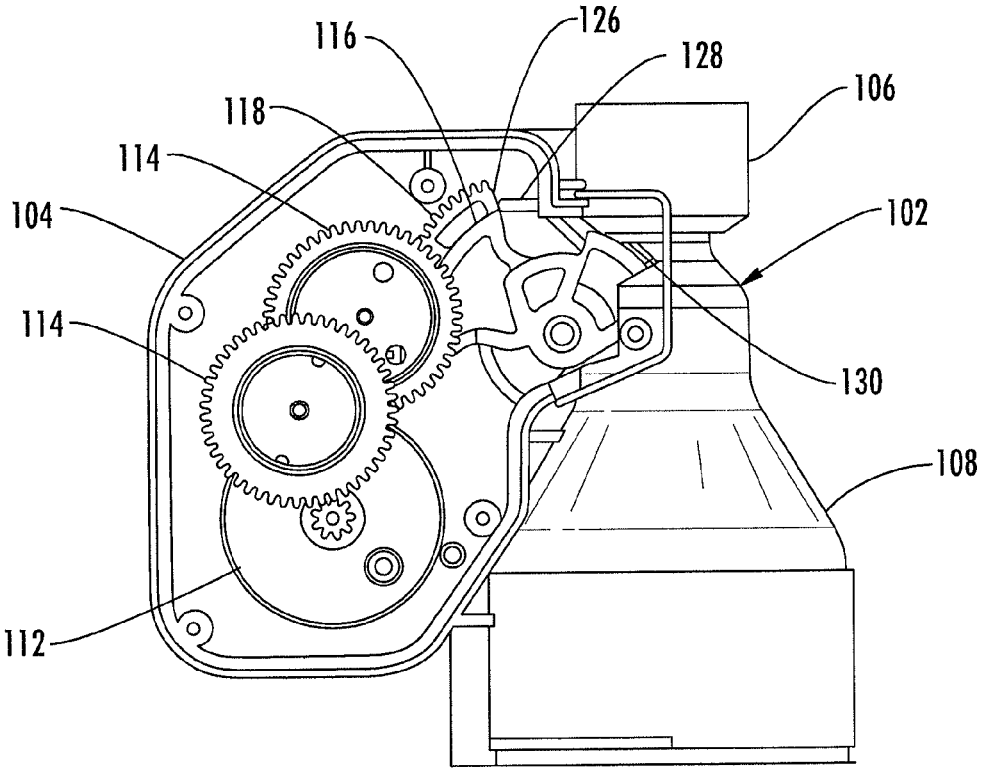
FIG. 4 is a schematic elevation view of the motor housing assembly of the system of FIG. 1.

Referring to FIG. 4, when the flat face 126 of the pump hammer 116 abuts hammer kick back stop 128, the motor 112 stalls and the current through the motor 112 increases. The increase in current through the stalled motor 112 is detected by circuitry (not shown), and the motor 112 is shut off, thus preventing the delivery of torque by the motor 112 to the pump hammer 116.

With the motor 112 shut off, the compression spring 352 urges the pump actuator 330 upwardly to its fully retracted and/or non-actuated position, whereby the flange 336 of the pump actuator 330 moves upward to force the pump hammer 116 to rotate counterclockwise back to its start position. Also, the pump is allowed to return to its rest state, where a spring 228 in the pump mechanism 200 biases the liquid piston 206, the pump piston 209 and the nozzle insert 212 upwardly, thereby urging the bayonette guide 340 to follow the pump actuator 330 until the second step portion 345 abuts the lower end of the cylindrical projection 337 of the cylindrical body 332 and the first step portion 343 abuts the underside of the annular seat flange 322 of the cap member 302. In this way, the draw-back chamber 350 expands during the return stroke, thereby creating a vacuum effect and drawing in foam soap from the dispensing tube 42 through the ports 348. As a result, foam soap is prevented from hanging at the end 44 of the dispensing tube 42 and dripping after a dose of foam soap has been dispensed.

In the pump and draw-back dispenser disclosed in U.S. Pat. No. 7,681,765 and U.S. Pat. No. 6,536,629, during the return stroke (where the pump moves from the actuated position to the non-actuated position) the closing of valve 221 against seat 219 occurs passively near the end of the return stroke. As a result, outlet 217 is not closed when the draw-back operation occurs such that an unmetered amount of liquid may be drawn from the container 70 into the liquid chamber 205 through inlet 210 due to the negative pressure created in the system by the draw-back mechanism 300. This unmetered amount of liquid creates a number of problems in the dispenser. First, the amount of foam soap delivered to the user varies from one cycle to the next cycle. Second, the variations in the amount of soap delivered on each cycle affects the number of cycles obtained from a container of liquid. Because the operation typically draws an extra amount of liquid into the pump on each return stroke, each dispensing cycle typically uses more liquid than needed or desired such that the number of dispensing cycles per container of liquid may be reduced. Finally, introducing additional liquid into the dispenser changes the ratio of liquid to air in the system such that the liquid may not be properly foamed.

The dispenser of the invention overcomes these problems by actively shutting outlet 217 to close the liquid chamber 205 at the end of the dispensing cycle prior to operation of the draw-back cycle. Because outlet 217 is actively shut, the low pressure created in the system by the drawback mechanism 300 is not communicated to container 70 such that liquid is not drawn into the liquid chamber 205 from container 70 during the draw-back cycle. As a result, liquid is only drawn into the liquid chamber 205 from the container 70 by the movement of valve 206.

To actively close the outlet 217 a closing force is applied to the valve component 218 to actively force the valve element 221 against the valve seat 219 at the end of the dispensing cycle. In one embodiment a spring is used to actively close outlet 217. In one embodiment the a spring 230 is trapped between the valve component 218 and the nozzle insert 212 to apply a force to the valve component 218 tending to force the valve element 2212 against the valve seat 219. The spring force is selected such that when the dispenser is actuated and the pistons 206, 209 are moved downwardly, the pressure in the liquid chamber 205 is sufficient to overcome the force generated by the spring 230 such that the outlet 217 is opened. The force generated by the flowing liquid on the valve element 221 distorts (e.g. compresses) the spring 230 such that energy is stored in the spring 230. When the pump actuator 330 is released and the pistons 206, 209 begin to return to the non-actuated position of FIG. 5, the pressure on the valve element 221 is released. The energy stored in the deformed spring 230 actively moves the valve element 221 against the valve seat 219 to actively close outlet 217 as the spring 230 returns toward its undeformed state. The spring force of spring 230 is sufficient to hold the valve member 221 against the valve seat 219 as the drawback mechanism 300 draws the foamed liquid back into the dispensing tube 32. The active closing of outlet 217 prevents liquid from being drawn into the pump from the container 70 during the draw-back operation such that only the desired metered amount of liquid is present in the system for the next cycle.

Figure 16:
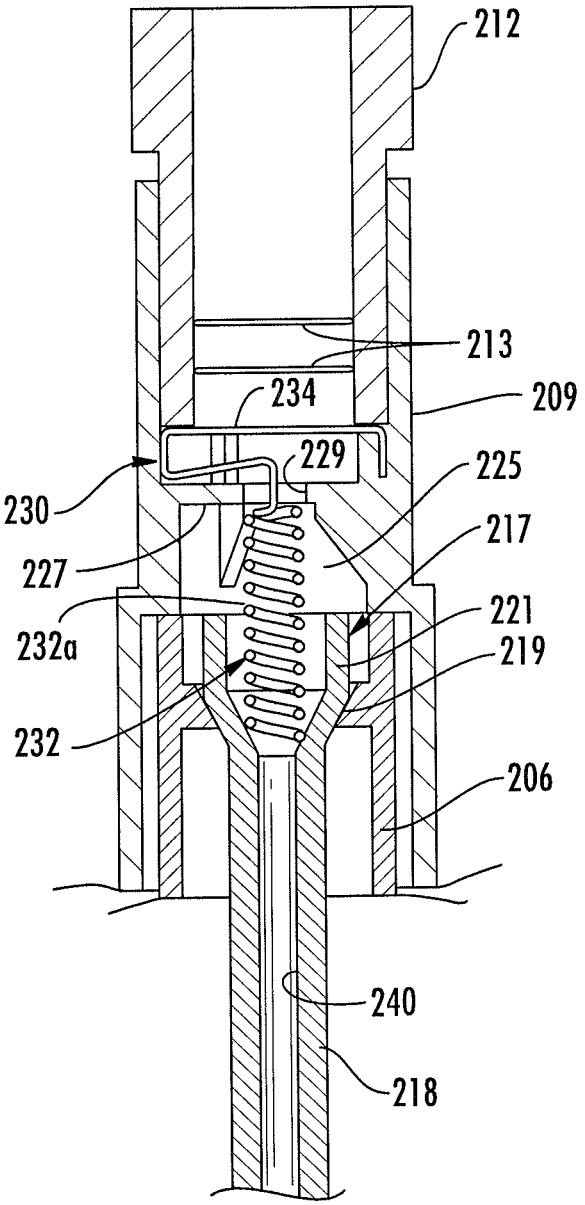
FIGS. 16-18 are detailed partial cross-sectional views of alternate embodiments of the pump of FIG. 14.
Figure 17:
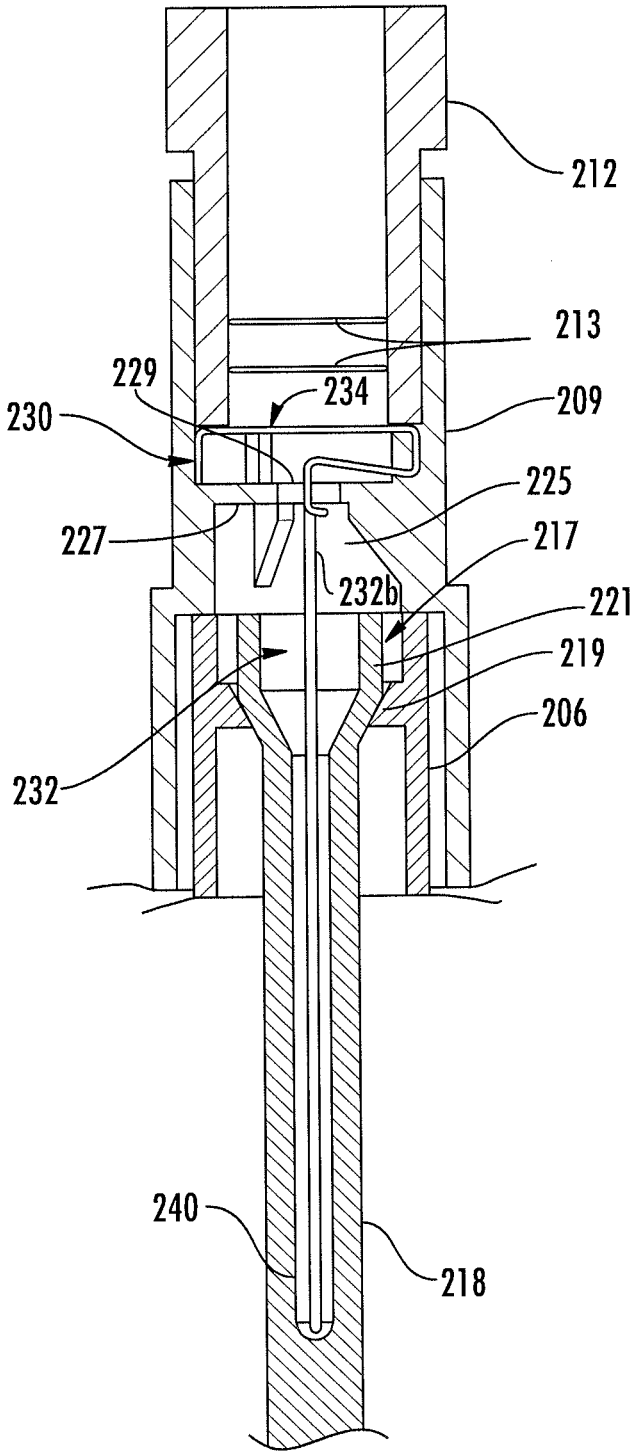
Figure 18:
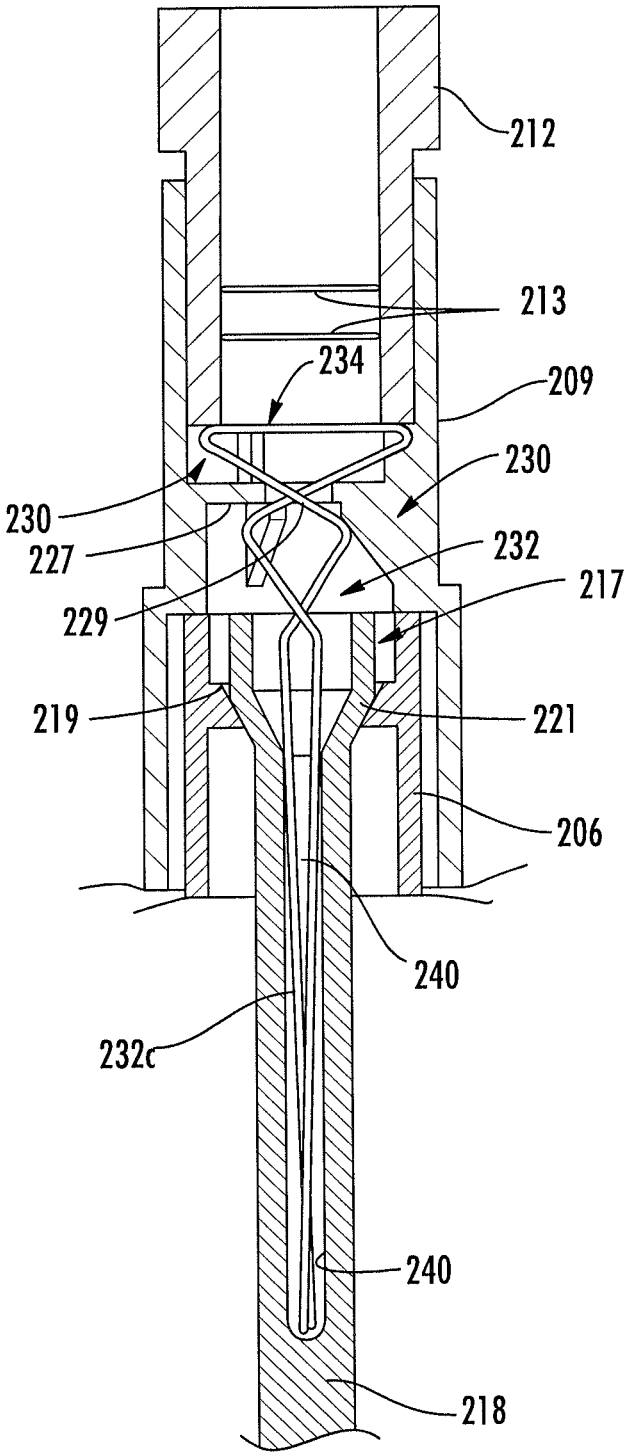

Referring to FIG. 16, in one embodiment the spring 230 comprises an elongated stem 232 that is inserted through the aperture 229 formed between the mixing chamber 225 and the valve insert 212 and a head 234 that is trapped between the nozzle insert 212 and the flange 227 that forms the aperture 229. When the pump is actuated the downward movement of the piston 209 compresses the spring 230 against the valve component 218 such that the spring 230 is deformed and stores the energy needed to close the valve. The head 234 of the spring, the stem 232 of the spring or both may be deformed to create the stored energy. Referring to FIG. 16 in one embodiment the stem 232 comprises a coil spring 232*a*, the stem 232 may also comprise a simple elongated member 232*b* as shown in FIG. 17, the spring 230 may comprise more complex shapes such as the serpentine or zig zag stem 232*c* as shown in FIG. 18; and/or other shapes that allow deformation of the spring when the spring is compressed. In some embodiments, the valve component 218 comprises a bore 240 that extends along the longitudinal axis of the valve component. The stem 232 may extend into the bore to retain the stem against the valve component 218.

Other constructions of the spring may be used to apply the closing force to the valve component 218; however, one advantage of the arrangement shown in the drawings is that the spring 230 may be added to existing pumps after the pump is manufactured to create the active closing in applications such as that described herein where passive closing of the valve is not suitable. In the existing pump design the nozzle insert 212 is easily removable from the pump. The spring 230 may be inserted into the open end of the pump vacated by the nozzle insert 212 with the spring stem extending through aperture 229 and into and engagement with the valve component 218. The nozzle insert 212 may be reinserted into the pump over the head of the spring 230 to trap the spring in position between the nozzle insert 212 and the valve member 218. When the pump is installed in the dispenser the nozzle insert 212 is trapped by the bayonnette guide 340, as previously explained, such that the valve insert holds the spring 230 in position and forms the abutment surface against which the spring is deformed. Thus, the spring configuration and arrangement shown and described herein allows an existing pump to be retrofitted with the spring 230; however, where a retrofit arrangement is not required the spring may be added during manufacture of the pump such that the spring may be arranged internally of the pump. Other arrangements of the spring are also possible provided that the spring provides a closing force on the valve where the closing force is low enough that it may be overcome by the pressure in the system upon actuation of the dispenser but is great enough to close the outlet 217 upon deactivation of the pump.

Method of Operation

Once properly installed, operation of the foam soap dispensing system 10 is initiated by a user inserting his or her hands near the electric eye assembly 38. The electric eye assembly 38 detects the presence of the hands, and sends a signal to actuate the motor 112. The gear reduction train 114 drives the pump hammer 116 in a clockwise direction, as viewed in FIGS. 2 and 6, whereby the actuator arms 124 positively engage the actuator flange 336 of the pump actuator 330 and drive the pump actuator 330 downward a predetermine distance. The downward movement of pump actuator 330 causes elongated dispensing tube 42 to withdraw the same distance into spout 24 and passageway 40. Preferably the tube end 44 of dispensing tube 42 remains outside of the spout opening 32 in spout 24 in the withdrawn position.

As the pump actuator 330 moves downward from its fully retracted and/or non-actuated position (see FIG. 12) under the influence of the pump hammer 116, a measured dosage of foam soap is dispensed from the tube end 44 of the dispensing tube 42, even as the dispensing tube 42 is pulled to its withdrawn position by the pump actuator 330. According to one embodiment, the pump mechanism 200 includes a self-priming pump that is filled with liquid soap prior to actuation of the pump mechanism 200. As pump actuator 330 moves downward, pump mechanism 200 creates foam soap by mixing liquid soap and air and expels the foam soap into the dispensing tube 42 through the bayonette guide 340. Also, the draw-back chamber 350 collapses, as shown in FIG. 13, forcing out residual soap material into the dispensing tube 42 through the ports 348 in the bayonette guide 340 to be dispensed with the main dose of foam soap from the pump mechanism 200.

Figure 12:
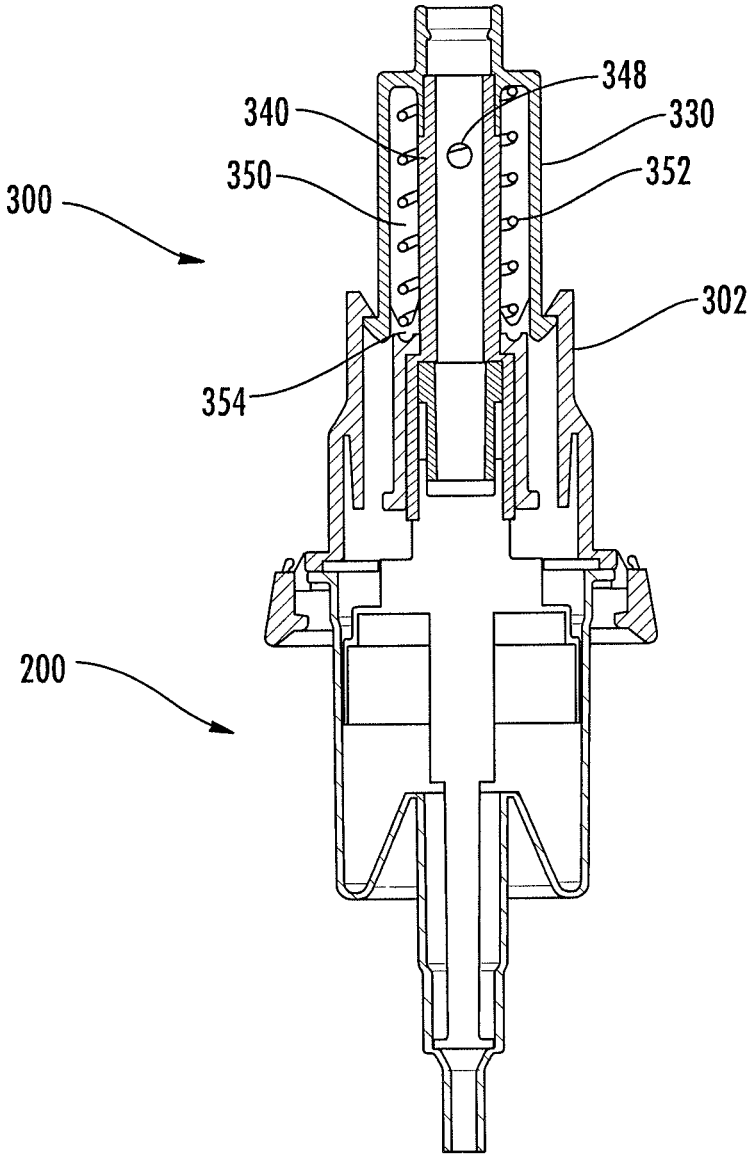
FIG. 12 is a cross-sectional elevation view of the draw-back assembly of the system of FIG. 1 including a schematic view of a pump assembly in a non-actuated position.

As pump hammer 116 reaches its limit of clockwise rotation, the motor 112 stalls and is shut off. When the motor 112 is shut off, the pump mechanism 200 is spring biased by spring 228 to return to its rest state. Spring 230 actively shuts outlet 217 by biasing valve element 2221 against the valve seat 219 to isolate the liquid chamber 205 and container 70 from the low pressure created in the system by the draw-back mechanism. The compression spring 352 urges the pump actuator 330 upwardly to its fully retracted position, forcing the pump hammer 116 to rotate counterclockwise back to its start position and the dispensing tube 42 to move upward back out of the spout opening 32 in the spout 24. As the pump actuator 330 moves upward, the draw-back chamber 350 expands, as shown in FIG. 12, to create a vacuum effect drawing foam soap from the dispensing tube 42 into the draw-back chamber 350 through the ports 348 of the bayonette guide 340. Because the spring 230 actively shuts outlet 217 the vacuum created in the system by the expansion of draw-back chamber 350 does not draw liquid from the container 70. In this way, the draw-back mechanism 330 prevents foam soap hanging and dripping from the tube end 44 of the dispensing tube 42 between uses while the active closing of opening 217 ensures that only the desired metered amount of liquid is drawn into the liquid chamber.

Various embodiments of the invention have been described and illustrated. However, the description and illustrations are by way of example only. Other embodiments and implementations are possible within the scope of the invention and will be apparent to those of ordinary skill in the art. Therefore, the invention is not limited to the specific details of the representative embodiments, and illustrated examples in this description. Accordingly, the invention is not to be restricted except as necessitated by the accompanying claims and their equivalents.

What is claimed is:

1. A dispensing system comprising:

a pump mechanism comprising a first inlet for delivering liquid from a container to the pump mechanism, the pump mechanism comprising a liquid chamber receiving the liquid from the first inlet, a liquid piston for delivering fluid from the liquid chamber to a mixing chamber through a first outlet; a valve component biased to close the first outlet, and a second inlet for delivering air to the pump mechanism, the pump mechanism comprising an air chamber receiving the air from the second inlet, an air piston for delivering air from the air chamber to the mixing chamber through a second outlet;

a bore configured to allow passage of a mixture of the air and the liquid from the mixing chamber to a dispensing tube;

a draw-back chamber;

a passageway between the bore and the drawback chamber;

a pump actuator movable between a first position and a second position to move the air piston and the liquid piston to propel a dose of the mixture of the air and the liquid through the bore and into the dispensing tube and to collapse the draw-back chamber, the draw-back chamber expanding to draw the mixture of the air and the liquid from the dispensing tube into the drawback chamber;

the valve component being biased to close the first outlet before the draw-back chamber expands.

2. The dispensing system of claim 1 wherein the dispensing tube is located in a spout.

3. The dispensing system of claim 2 wherein the inlet is connected to a suction tube configured to be disposed in a container of liquid.

4. The dispensing system of claim 1 wherein a bayonette guide is mounted for movement with the pump actuator and defines the bore extending through the bayonette guide.

5. The dispensing system of claim 4 wherein the draw-back chamber is formed between the pump actuator and the bayonette guide.

6. The dispensing system of claim 1 wherein the draw-back chamber surrounds the bore.

7. The dispensing system of claim 1 wherein a pump motor moves the pump actuator to the first position.

8. The dispensing system of claim 1 wherein a spring biases the pump actuator to the second position.

9. The dispensing system of claim 8 wherein when the draw-back chamber collapses the spring is compressed.

10. The dispensing system of claim 1 wherein the pump mechanism includes a nozzle insert that receives the mixture of the air and the liquid from the mixing chamber.

11. The dispensing system of claim 1 wherein a spring biases the valve component to close the first outlet.

12. The dispensing system of claim 10 wherein the pump mechanism includes a nozzle insert that receives the mixture of the air and the liquid from the mixing chamber.

13. The dispensing system of claim 12 wherein the spring is disposed between the valve component and the nozzle insert.

14. The dispensing system of claim 13 wherein the nozzle insert is removable from the pump mechanism to allow the spring to be inserted into engagement with the valve component.

15. The dispensing system of claim 12 wherein the spring is compressed against the nozzle insert.

16. The dispensing system of claim 11 wherein the spring is compressed when the air piston moves.

17. The dispensing system of claim 11 wherein the spring comprises an elongated stem that extends from the mixing chamber to the valve component.

18. The dispensing system of claim 17 wherein the stem is one of a coil, a linear member and a serpentine member.

19. The dispensing system of claim 17 wherein the spring comprises a head that is disposed between the mixing chamber and the dispensing tube.

20. A method of dispensing a liquid air mixture using the dispensing system of claim 1, comprising:

creating a first vacuum in the pump mechanism to draw the liquid through the first inlet and air from the second inlet;

creating a high pressure in the pump mechanism to force the liquid through the first outlet and air through the second outlet into the mixing chamber and through the dispensing tube;

creating a second vacuum in the draw-back chamber to draw the mixture of the air and the liquid from the dispensing tube into the draw-back chamber;

closing the first outlet before the second vacuum is created.

* * * * *